United States Patent [19]

Humpherys et al.

[11] Patent Number: 4,943,184

[45] Date of Patent: Jul. 24, 1990

[54] IRRIGATION DEVICE

[75] Inventors: Allan S. Humpherys, Kimberly, Id.; Elvert E. Oest, Fruita, Colo.

[73] Assignees: The United State of America as represented by the Secretary of Agriculture, Washington, D.C.; Elvert Edgar Oest & Company, Fruita, Colo.

[21] Appl. No.: 281,733

[22] Filed: Dec. 9, 1988

[51] Int. Cl.[5] ..... E02B 13/00

[52] U.S. Cl. ..... 405/39; 405/36

[58] Field of Search ..... 405/36, 39–41; 248/71; 138/37, 111, 115, 119

[56] References Cited

U.S. PATENT DOCUMENTS

| | | | |
|---|---|---|---|
| 1,529,881 | 3/1925 | Engle | 248/71 |
| 3,464,209 | 9/1969 | Redditt | 405/40 |
| 3,468,130 | 9/1969 | Gibson | 405/39 |

OTHER PUBLICATIONS

"An Automated Single-Pipe Irrigation System", Transactions of the ASAE (vol. 29, No. 1, pp. 185–193, 1986).

*Primary Examiner*—David H. Corbin

*Attorney, Agent, or Firm*—M. Howard Silverstein; John D. Fado

[57] ABSTRACT

An elongated, flexible unitary sheet having two longitudinal borders, said sheet being folded lengthwise, in thirds, to define a first elongated fold of said sheet sandwiched between second and third elongated folds; wherein each of said two longitudinal borders is opposite a face of one of said folds and is sealed thereto so that said second and third folds together define the outer wall of a substantially enclosed conduit and so that said first fold provides a diaphragm dividing said conduit into first and second channels; a pipe detachably connected to the upstream end of the conduit, said pipe including flow control means to stop the flow of fluid to either one of said channels while still permitting flow to the other of said channels. The flow control means comprises a longitudinal membrane in the pipe which is connected at its downstream end to the first fold, and which includes a flat elongated spring at its upstream end to move the upstream end from one inner pipe surface to an opposite inner surface.

33 Claims, 4 Drawing Sheets

IRRIGATION DEVICE

FIELD

This invention relates to a device for controlling the flow of irrigation water.

PRIOR ART

U.S. Pat. Nos. 3,464,209 and 3,468,130 describe a device which includes a rigid conduit (pipe or open channel) and a longitudinal diaphragm within the conduit. In the irrigation mode, water passes under the diaphragm and discharges through openings in the bottom of the conduit. In the conveyance mode, water flows only on top of the diaphragm. A flow control means is employed to move the upstream end of the diaphragm so as to permit water to flow either under or over the diaphragm, while the downstream end of the diaphragm is fixed to the lower interior surface of the conduit. Typically, the conduit extends transversely across a row of furrows, and appropriate conduit openings are provided in the bottom thereof to discharge water into each of the furrows.

This prior art device has not been commercialized because of the difficulty, cost and impracticality of constructing same.

A variation of this concept is disclosed in Transactions of the ASAE, vol. 29, No. 1, pp185–193, 1986, by A. S. Humpherys, wherein a flexible tube liner is inserted into a rigid pipe, and control of irrigation is accomplished by diverting the water either through or on the outside of the tube.

SUMMARY

We now have developed a new and improved irrigation conduit wherein a diaphragm generally of the type disclosed in the above-identified patents is incorporated into prior art layflat tubing to define two parallel, elongated channels therein. Such prior art layflat tubing generally is fabricated from flexible, water-impermeable sheet material, which becomes inflated to a cylindrical shape when filled with water. The upstream end of the tubing of the present invention is detachably connected to the downstream end of a pipe so that the two channels in the tubing are in communication with the interior of the pipe. A flow control means is connected to the pipe to stop the flow of fluids to either one of the two channels while still permitting flow to the other channel. The outer wall of the tubing may be perforate or imperforate, as desired, so that a flow channel simply may function as a water pass-through or conveyance conduit, or it may function to transport water to the perforations.

The tubing-diaphragm combination of the present invention may be fabricated from a single, unitary, elongated sheet of flexible, fluid-impermeable material. The sheet is folded lengthwise, in thirds, to define one elongated fold sandwiched between two other elongated folds; wherein said one fold defines the tubing diaphragm, and the two other folds define the outer wall of the tubing.

While different types of flow controls may be connected to the pipe which is detachably attached to the multi-channeled conduit of the present invention, the invention also provides a unique flow control. It comprises a fluid-impermeable membrane extending through said pipe to divide it into two pipe channels. The downstream end of the pipe membrane is detachably joined to the diaphragm of the multi-channeled conduit. The upstream end of the pipe membrane is composed of flexible material, the width of which is approximately equal to half the inner circumference of the pipe; and the upstream end of the membrane includes means to move it into a sealing, conforming engagement with the inner wall surface of the pipe.

It therefore is an object of the present invention to provide a low-cost means of utilizing or exploiting the diaphragm concept of the above-identified prior art.

Another object is to provide irrigation conduit means that are readily constructed, dismantled, stored, transported, and subsequently re-installed.

A further object is to provide a unique flow control valve to control flow of fluids such as water through multi-channeled conduits connected to the downstream end of the valve.

THE DRAWINGS

FIG. 1 is an end view of the layflat tubing of the present invention in a partially inflated condition.

FIG. 1*a* is an alternative embodiment of the tubing.

FIG. 2 is a partially cut-away, perspective view of the pipe which includes the flow control means or diverter valve of the present invention.

FIG. 2*a* is an end view of the pipe with its diverter valve in one of its operational positions.

FIG. 2*b* is a cross-sectional partial end view of details of the valve.

FIG. 2*c* is a front view of the preferred shape of part of the valve.

Figure 5:
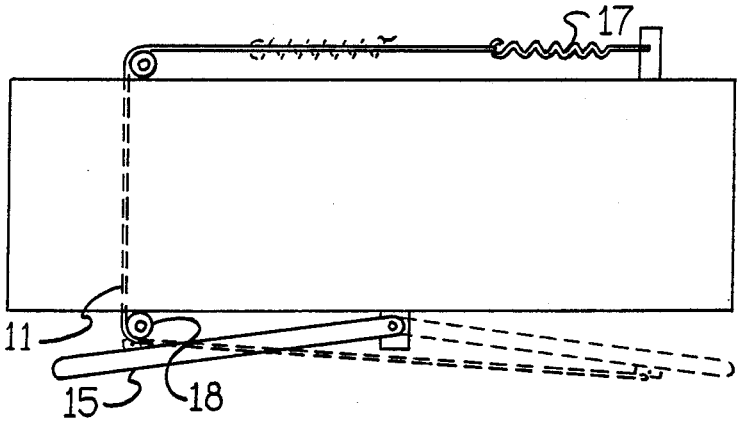
FIG. 5 is a side view of the pipe having a simple lever attached thereto for moving the diverter valve.
Figure 5A:
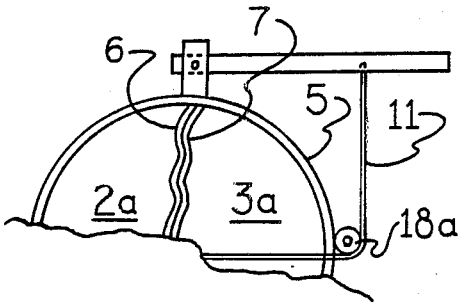

FIG. 5*a* is an end view of an alternative embodiment of FIG. 5.

Figure 6:
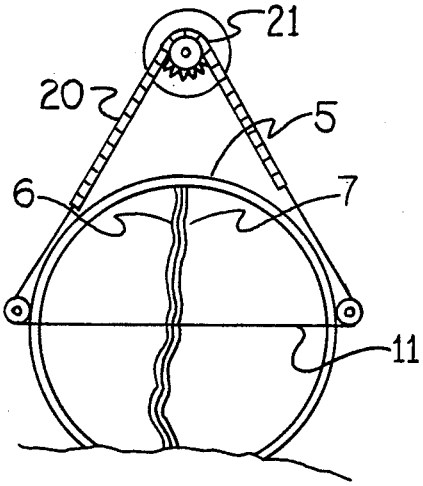

FIG. 6 is an end view of the pipe having chains and pulleys for moving the diverter valve.

Figure 7:
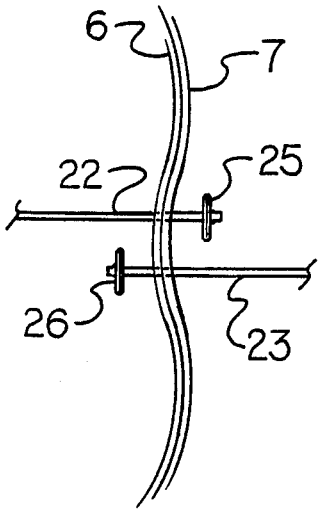

FIG. 7 is a partial end view of a preferred cable arrangement.

Figure 8:
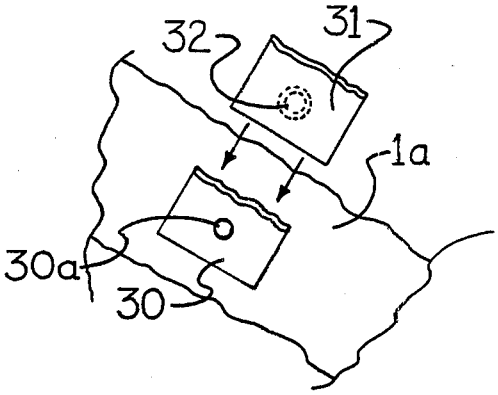

FIG. 8 is a partial perspective view of the layflat tubing having means for controlling the flow of water out of each of the holes in the tubing.

Figure 9:
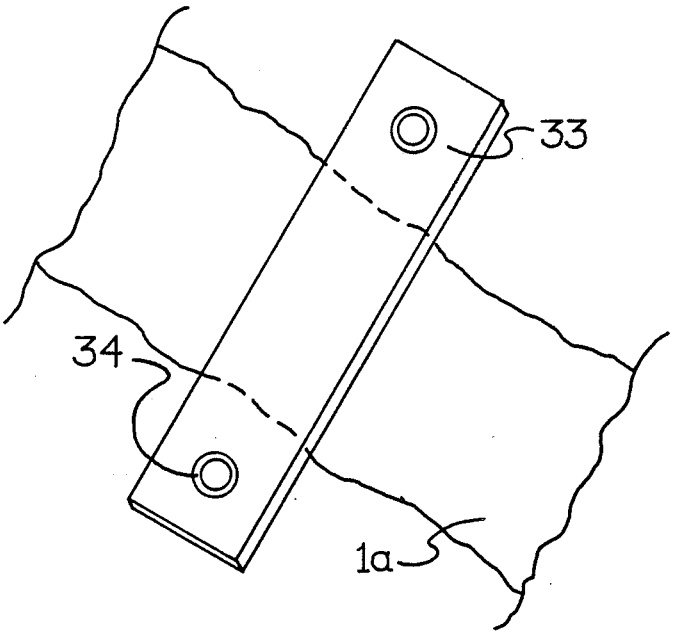

FIG. 9 is a partial view of the layflat tubing with anchor means attached thereto.

DETAILED DESCRIPTION

Figure 1:
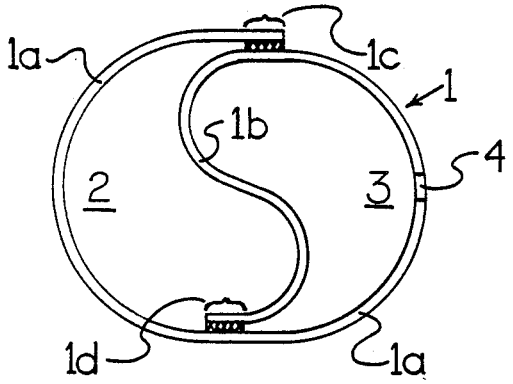

Reference numeral 1 of FIG. 1 designates the layflat tubing of the present invention in a partially inflated state. The flexible outer wall of the tubing is designated by numeral 1*a*, and the septum or diaphragm is designated by 1*b*. As can be seen from the figure, the device is constructed of a single sheet of material which essentially has been folded in thirds along its length. Each outer longitudinal border, 1*c* and 1*d*, of the single sheet of material, is opposite a face of one of the folds, and is sealed or otherwise secured thereto so that the resultant conduit is substantially enclosed along its length, and so that diaphragm 1*b* defines two parallel, elongated, substantially enclosed channels 2 and 3 within the tubing. The only openings along the length of the tubing are the appropriate irrigation openings or holes 4 in the tube wall of channel 3. For the purposes of this specification and claims, the channel that includes irrigation openings or holes 4 shall be referred to as the discharge channel, while the channel without such openings shall be referred to as the conveyance channel. The longitudinal borders 1c and 1d of the sheet material each may be sealed to its respective facing fold by heat-sealing, stitching or with appropriate sealants.

Figure 1A:
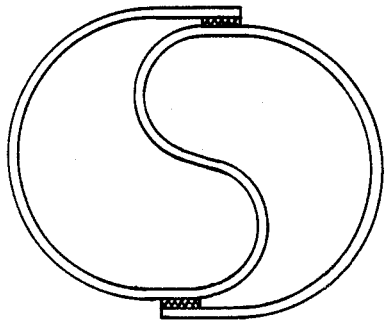

FIG. 1a illustrates an optional way to fold the single sheet of material into thirds and still provide the layflat tubing of the present invention.

Although not illustrated nor preferred, the layflat tubing of the present invention may be fabricated from separate pieces of sheet material sealed together, rather than from a single sheet.

Figure 2:
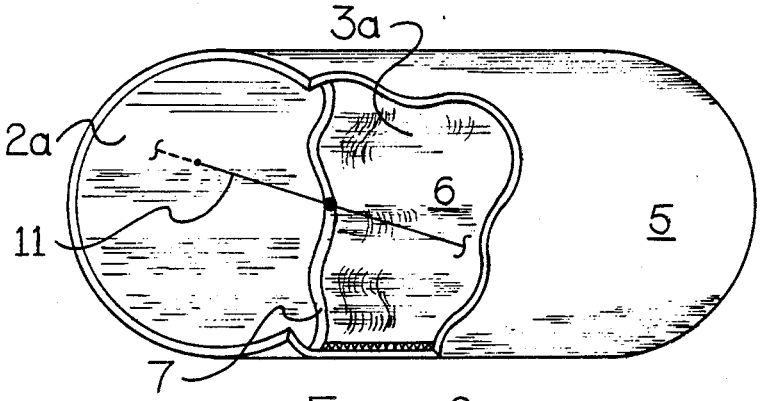

The flow control means or diverter valve is illustrated in FIG. 2. Reference numeral 5 designates a short piece of rigid pipe. The upstream end of the pipe may be connected to a fluid or water supply in the prior art manner. Inside the pipe is a membrane 6, the longitudinal edges of which are sealed to opposite sides of the inner wall of pipe 5 with for example rubberized cement to define longitudinal pipe channels 2a and 3a. The upstream end of the membrane material is composed of flexible, impermeable sheet material having a width approximately equal to half the inner circumference of pipe 5. A flat, elongated spring 7, transversely disposed within the pipe, is secured on one of its faces along its length to the upstream end of membrane 6 with, for example, rubberized cement. The length of the spring is approximately equal to half the inner circumference of pipe 5. Spring 7, while preferably metal, also may be fabricated from stiff rubber or flexible plastic.

Although membrane 6 preferably is a single, unitary sheet, usually of the same kind of material as tubing 1, it may be fabricated of multiple components, wherein, for example, the end segments are flexible material, while the mid section is rigid.

A cable or rod 11 passes through opposing holes in the rigid pipe 5, and is connected at one point along its length to the center of spring 7 and membrane 6, so that longitudinal movement of the cable in either direction results in movement of the spring and membrane toward either one of two opposing inner wall surfaces of pipe 5. In this manner the upstream end of membrane 6 and spring 7 may firmly engage and conform to the inner wall surface of pipe 5 along half the inner circumference of the pipe (cross-setionally speaking), as illustrated for example, in FIG. 2a, so that only one of the pipe channels 2a or 3a is in communication with an upstream water supply.

Figure 2A:
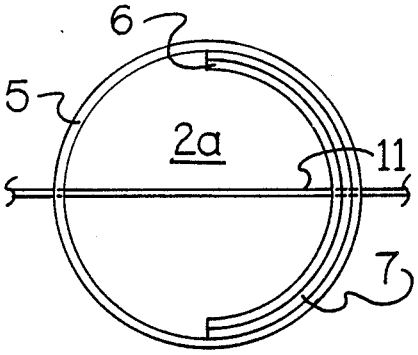
Figure 2B:
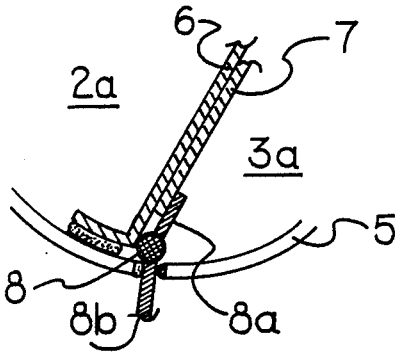

Referring to FIG. 2b, each end of spring 7 may be secured to rigid pipe 5 by attaching it as by welding to an arm 8a of a hinge 8, and thereafter sealing the other arm 8b of the hinge in a slot in the pipe. To provide stronger anchorage for hinge arm 8b, it may project beyond the outside of wall 5 to be secured in the aperture of a plug or block which in turn is attached to the pipe by cementing or other fastening means at the pipe's slot.

Figure 2C:
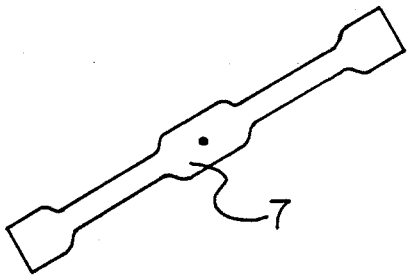

FIG. 2c illustrates a preferred embodiment of the flat spring 7 having three wide sections (at its center and ends) joined by narrow channels.

Figure 3:
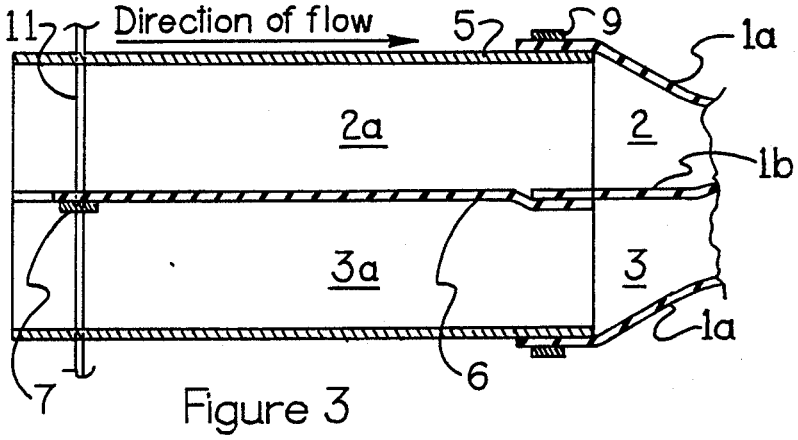
FIG. 3 is a cross-sectional view along the top of the pipe with layflat tubing attached to the downstream end of the pipe.

Referring to FIG. 3, the upstream end of layflat tubing 1 is connected to pipe 5 by slipping tubing wall 1a over the outside of the downstream end of the pipe, and securing it thereto with, for example, a tubing clamp 9. In this manner, the two folds which define tubing wall 1a are displaced outwardly in opposite directions whereby an end opening is defined in the tubing which configures to the perimeter of the pipe.

Prior to attaching tubing wall 1a to pipe 5, the upstream end of diaphragm 1b is cut away from tubing wall 1a a short distance (about 2 inches) on each side, so as to form a tongue-like segment of diaphragm 1b which penetrates into the downstream end of pipe 5. The tongue-like segment of 1b is detachably joined to membrane 6 with any appropiate sealant or fastening means to establish co-extensive channels 2a,2 and 3a,3 between pipe 5 and tubing 1. Velcro-like fasteners are the preferred joining means because of easy assembly and disassembly.

In operation, movement of spring 7 and membrane 6 to the far right as shown in FIG. 2a, establishes flow of fluid only through co-extensive channels 2a, 2 in pipe 5 and tubing 1. If the spring and membrane 6 are moved to the far left, as viewed from the perspective of FIG. 2a, then flow of fluid is established only through co-extensive channels 3a, 3.

Instead of connecting the upstream end of pipe 5 to a water supply, it may be employed to link two consecutive segments of layflat tubing to one another. In this latter arrangement, the downstream tubing segment is attached as shown in FIG. 3, while the upstream segment is connected to the valve as shown in FIG. 4.

Figure 4:
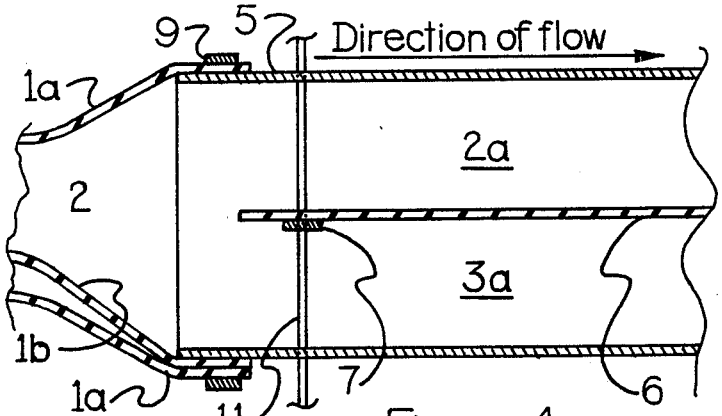
FIG. 4 is a partial cross-sectional view along the top of the pipe with layflat tubing attached to the upstream end of the pipe.

Referring to FIG. 4, diaphragm 1b of the upstream tubing segment first is positioned adjacent to the discharge side of its tube wall 1a (i.e., the side with openings or holes 4), and thereafter it is slipped around and clamped to the outside of the pipe together with its respective tubing wall 1a. In this manner water may be caused to flow through tubing channel 2 of the upstream tubing segment, and thereafter through either conveyance channel 2 or through discharge channel 3 of the downstream tubing segment; or water may be caused to flow through the discharge channel of the upstream segment, and not at all through downstream pipe 5 or the downstream tubing segment. Other flow pattern variations will be obvious to those skilled in the art.

The downstream end of the final piece of layflat tubing may be attached to a rigid end cap or pipe by positioning its diaphragm to the discharge side of the tubing, slipping both the diaphragm and tubing wall around the outside of the end cap or pipe, and thereafter clamping to same, in the same manner as the upstream attachment to pipe 5, as shown for example in FIG. 4.

In some instances, two pieces of tubing may be linked together through a rigid pipe which does not incoporate a control or diverter valve but which nonetheless includes an internal flexible pipe membrane as in pipe 5 of FIG. 2. Both the upstream and downstream tubing segments connected to such a link may be attached as shown in FIG. 3, i.e., each tubing's diaphragm or septum 1b may be joined to the connector pipe membrane at opposite ends thereof, and outer wall 1a of each tubing segment may be clamped to the outside of the connector pipe at opposite ends thereof. The use of such connector pipes or tubing couplers provides an essentially continuous diaphragm having the length of two or more tubing segments.

There are many mechanical devices that may be employed to move the cable or rod 11 which is attached to spring 7. A comparatively simple, manually controlled cable puller is illustrated in FIG. 5. Referring thereto, a lever 15 is pivotally secured at one end to pipe 5. Cable 11, which passes over pulley 18, is attached to the lever near the center thereof. Movement of the lever as shown by the dotted lines results in pulling the cable from the pipe. An extension spring 17 mounted on the opposite side of pipe 5, in conjunction with another pulley, retracts or returns the cable to its former position when lever 15 is released. Other retraction means such as a coil spring or counterweight also are suitable.

As shown in FIG. 5*a*, the lever optionally may be transversely mounted on the pipe. Either of the embodiments in FIGS. 5 and 5*a* may be partly or fully automated by means of solenoids and latching devices, which will be obvious to those skilled in the art.

Another cable moving device is illustrated in FIG. 6, wherein the cable is attached to a chain 20 driven by a motor-powered sprocket 21. Automatic operation of the motor may be provided by connecting it to appropriate timers (not shown).

Semi-automatic operation of cable movement may be provided by pulling the cable with a spring such as a tension or constant force spring, whenever a manually-resettable latching device is tripped by a timer or controller.

A preferred embodiment of the means for moving spring 7 is illustrated in FIG. 7. Therein two cables 22, 23 pass through membrane 6 and spring 7 at or near the spring's center. The cables are not fixed to the spring. Rather, washers 25 and 26 at the ends of the cables provide the connection between spring and cable, and force the membrane to move whenever one of the cables is pulled outwardly from the rigid pipe 5. Obviously, whenever one of the cables intentionally is being pulled, cable restraint is removed from the other cable so that said other cable is permitted to move and thereby does not prevent movement from the pulled cable. By pulling the spring 7 in this manner, the membrane may be moved to either side of the inner pipe wall surface. Means for simultaneously moving each of the two cables may include manual or motor-driven wind-up spools. Optionally, cable 22 may be attached to a lever, while the end of cable 23 is connected to a return spring. In this latter arrangement, the return spring stretches out at the end of cable 22 when the lever pulls on cable 23; and the return spring pulls on cable 22 when the lever is returned to its no-pull position with respect to cable 23.

Referring now to FIG. 8, in order to control the flow of water into each furrow through the openings or holes 4 (see FIG. 1) in the wall 1*a* of the tubing, a pocket 30 may be formed at each opening or hole by fastening (e.g., stitching, sealing) a piece of flexible material thereover. The pocket includes a hole or opening 30*a* aligned with a hole 4 in the tube wall 1*a*. A rigid or semi-rigid tab 31 is dimensioned to tightly slip into the pocket, and be positioned to shut off or control the degree of opening at the aligned holes. Tab 31 may include an o-ring 32 (shown by dotted lines) securely fastened on the backside thereof so that the tab will firmly fit in the pocket, and firmly seal the hole in the tube wall 1*a* when fully inserted into the pocket.

Occasionally it may be necessary to place the layflat tubing on uneven or sloping ground, or to prevent it from being windblown prior to being filled with water. As shown in FIG. 9, in order to hold the tubing in place in such situations, flexible straps 33 fabricated of a material similar to or the same as the tubing may be secured to the outside of the tubing at appropriate intervals, which straps include loose flaps which extend transversely from the tubing and include grommeted openings 34 therein so that tent-like pegs may be driven into the ground or other substrate and tried by rope to such grommeted openings. An optional way to produce flap-containing layflat tubing is to fasten the flaps at appropriate places on the sheet material prior to folding the sheet material into layflat tubing. Yet another way to produce flaps is to seal the border 1*c* (see FIG. 1) to its opposing fold at a point a few inches inward from the actual longitudinal edge of the sheet material, so that a longitudinal flap inherently is produced in the layflat tubing.

Exemplary dimensions of the unit of the present invention are as follows: The diameter of layflat tubing when fully inflated may be 6 to 12 inches. The diverter pipe may be about 18 inches in length. A tubing coupler may be about 12 inches in length. Tubing segment lengths may vary widely depending upon individual circumstances. Typical lengths may be 50–150 feet.

Any commercially available suitable flexible, water-impermeable sheet material may be employed in the layflat tubing and pipe membrane of the present invention, such as nylon fabric impregnated with neoprene, PVC, or other appropriate plastic sheet material. A typical sheet or tubing wall thickness is about 0.02 inches.

We claim:

1. An apparatus comprising a segment of elongated layflat tubing fabricated from flexible sheet material which becomes inflated to a cylindrical shape when filled with fluid, said tubing including a longitudinal diaphragm within said tubing which defines two parallel, elongated channels therein; a rigid pipe detachably connected to the upstream end of said tubing so that said channels are in communication with the interior of said pipe, flow control means connected to said pipe to stop the flow of fluids to either one of said channels while still permitting flow to the other of said channels, wherein said pipe is not fabricated of flexible sheet material.

2. The apparatus of claim 1 wherein said layflat tubing comprises an elongated unitary sheet of fluid-impermeable material, said sheet being folded lengthwise, in thirds, to define one fold sandwiched between two other folds; wherein said one fold defines said diaphragm, and said two other folds define said layflat tubing's outer wall.

3. The apparatus of claim 1 wherein said flow control means comprises a longitudinal membrane within said pipe; wherein said tubing diaphragm is detachably joined to the downstream end of said pipe's membrane.

4. The apparatus of claim 1 further including flap means extending transversely from said layflat tubing, said flap means including holes therein to secure said layflat tubing to a substrate.

5. The apparatus of claim 2 further including flap means extending transversely from said layflat tubing, said flap means including holes therein to secure said layflat tubing to a substrate.

6. The apparatus of claim 3 wherein the upstream end of said pipe's membrane's is composed of flexible material having a width which is approximately equal to half the inner circumference of said pipe; and means connected to said membrane's upstream end to move it from one inner side surface of said pipe to the opposite inner side surface.

7. The apparatus of claim 6 wherein said layflat tubing comprises an elongated unitary sheet of fluid-impermeable material, said sheet being folded lengthwise, in thirds, to define one fold sandwiched between two other folds; wherein said one fold defines said diaphragm, and said two other folds define said layflat tubing's outer wall.

8. The apparatus of claim 6 wherein said tubing includes holes in its outer wall so that any fluids flowing through at least one of said channels in said tubing may exit through said holes.

9. The apparatus of claim 7 further including flap means extending transversely from said layflat tubing, said flap means including holes therein to secure said layflat tubing to a substrate.

10. The apparatus of claim 8 wherein said layflat tubing comprises an elongated unitary sheet of fluid-impermeable material, said sheet being folded lengthwise, in thirds, to define one fold sandwiched between two other folds; wherein said one fold defines said diaphragm, and said two other folds define said layflat tubing's outer wall.

11. The apparatus of claim 8 further including a second segment of layflat tubing essentially identical to the first mentioned segment; wherein said second segment is connected to the upstream end of said pipe by detachably connecting said second segment's outer wall and diaphragm to the outside of said pipe.

12. The apparatus of claim 10 further including flap means extending transversely from said layflat tubing, said flap means including holes therein to secure said layflat tubing to a substrate.

13. An apparatus comprising a segment of elongated layflat tubing including a longitudinal diaphragm within said tubing which defines two parallel, elongated channels therein; a rigid pipe detachably connected to the upstream end of said tubing so that said channels are in communication with the interior of said pipe, flow control means connected to said pipe to stop the flow of fluids to either one of said channels while still permitting flow to the other of said channels, wherein said flow control means comprises a longitudinal membrane within said pipe; wherein said tubing diaphragm is detachably joined to the downstream end of said pipe's diaphragm, wherein the upstream end of said pipe's membrane is composed of flexible material having a width which is approximately equal to half the inner circumference of said pipe; means connected to said membrane's upstream end to move it from one inner side surface of said pipe to the opposite inner side surface, wherein said means to move the upstream end of said pipe's membrane comprises an elongated flat spring transversely disposed within said pipe and connected along its length to said membrane's upstream end.

14. The apparatus of claim 13 further including a first cable or rod connected to said spring; and means to move said cable or rod.

15. The apparatus of claim 13 wherein said tubing includes holes in its outer wall so that any fluids flowing through at least one of said channels in said tubing may exit through said holes.

16. The apparatus of claim 14 wherein said layflat tubing comprises an elongated unitary sheet of fluid-impermeable material, said sheet being folded lengthwise, in thirds, to define one fold sandwiched between two other folds; wherein said one fold defines said diaphragm, and said two other folds define said layflat tubing's outer wall.

17. The apparatus of claim 14 further including a second cable or rod connected to said spring; and means to move said second cable or rod; wherein said first and second cable or rod moving means move said spring in opposite directions.

18. The apparatus of claim 15 wherein said layflat tubing comprises an elongated unitary sheet of fluid-impermeable material, said sheet being folded lengthwise, in thirds, to define one fold sandwiched between two other folds; wherein said one fold defines said diaphragm, and said two other folds define said layflat tubing's outer wall.

19. The apparatus of claim 15 further including at least one flexible pocket sealed to the outside of said tubing adjacent and covering a hole therein, wherein said pocket includes an opening aligned with said covered hole; and a tab firmly inserted into said pocket to control the degree of opening of said covered hole.

20. The apparatus of claim 15 further including a second segment of layflat tubing essentially identical to the first mentioned segment; wherein said second segment is connected to the upstream end of said pipe by detachably connecting said second segment's outer wall and diaphragm to the outside of said pipe.

21. The apparatus of claim 16 further including flap means extending transversely from said layflat tubing, said flap means including holes therein to secure said layflat tubing to a substrate.

22. The apparatus of claim 17 further including a second segment of layflat tubing essentially identical to the first mentioned segment; wherein said second segment is connected to the upstream end of said pipe by detachably connecting said second segment's outer wall and diaphragm to the outside of said pipe.

23. The apparatus of claim 20 further including a first cable or rod connected to said spring; and means to move said cable or rod.

24. The apparatus of claim 23 wherein said layflat tubing comprises an elongated unitary sheet of fluid-impermeable material, said sheet being folded lengthwise, in thirds, to define one fold sandwiched between two other folds; wherein said one fold defines said diaphragm, and said two other folds define said layflat tubing's outer wall.

25. The apparatus of claim 23 further including at least one flexible pocket sealed to the outside of said tubing adjacent and covering a hole therein, wherein said pocket includes an opening aligned with said covered hole; and a tab firmly inserted into said pocket to control the degree of opening of said covered hole.

26. The apparatus of claim 23 further including a second cable or rod connected to said spring; and means to move said second cable or rod; wherein said first and second cable or rod moving means move said spring in opposite directions.

27. An apparatus comprising a segment of elongated layflat tubing including a longitudinal diaphragm within said tubing which defines two parallel, elongated channels therein; a rigid pipe detachably connected to the upstream end of said tubing so that said channels are in communication with the interior of said pipe, flow control means connected to said pipe to stop the flow of fluids to either one of said channels while still permitting flow to the other of said channels, wherein said flow control means comprises a longitudinal membrane within said pipe; wherein said tubing diaphragm is detachably joined to the downstream end of said pipe's diaphragm, wherein the upstream end of said pipe's membrane is composed of flexible material having a width which is approximately equal to half the inner circumference of said pipe; means connected to said membrane's upstream end to move it from one inner side surface of said pipe to the opposite inner side surface, wherein said tubing includes holes in its outer wall so that any fluids flowing through at least one of said channels in said tubing may exit through said holes, further including at least one flexible pocket sealed to the outside of said tubing adjacent and covering a hole therein, wherein said pocket includes an opening aligned with said hole; and a tab firmly inserted into said pocket to control the degree of opening of said covered hole.

28. The apparatus of claim 27 wherein said layflat tubing comprises an elongated unitary sheet of fluid-impermeable material, said sheet being folded lengthwise, in thirds, to define one fold sandwiched between two other folds; wherein said one fold defines said diaphragm, and said two other folds define said layflat tubing's outer wall.

29. Flow control means comprising:

(a) a rigid pipe;

(b) a longitudinal membrane within said pipe dividing it into two parallel pipe channels, the upstream end of said membrane being a flexible, fluid-impermeable material having a width approximately equal to half the inner circumference of said pipe;

(c) means to move said upstream end of said membrane from one inner pipe surface to the opposing inner pipe surface;

(d) a first multi-channeled conduit detachably connected to the downstream end of said pipe so that each of said pipe's channels is co-extensive with separate channels in said multi-channeled conduit; and (e) a second multi-channeled conduit detachably connected to the upstream end of said pipe wherein a channel in said second conduit is not in fluid communication with said pipe.

30. Flow control apparatus comprising:

(a) a rigid pipe;

(b) a longitudinal membrane within said pipe dividing it into two parallel pipe channels, the upstream end of said membrane being a flexible, fluid-impermeable material having a width approximately equal to half the inner circumference of said pipe;

(c) means to move said upstream end of said membrane from one inner pipe surface to the opposing inner pipe surface;

(d) a first multi-channeled conduit detachably connected to the downstream end of said pipe so that each of said pipe's channels is co-extensive with separate channels in said multi-channeled conduit;

(e) a second multi-channeled conduit connected to the upstream end of said pipe, wherein a channel in said second conduit is not in fluid communication with said pipe;

(f) wherein said means to move said membrane's upstream end comprises an elongated flat spring transversely disposed within said pipe and connected along its length to said membrane's upstream end.

31. The apparatus of claim 30 further including a first cable or rod connected to said spring; and means to move said cable or rod.

32. The apparatus of claim 31 further including a second cable or rod connected to said spring; and means to move said second cable or rod; wherein said first and second cable or rod moving means move said spring in opposite directions.

33. The apparatus of claim 32 further including a second multi-channeled conduit connected to the upstream end of said pipe wherein a channel in said second conduit is not in fluid communication with said pipe.

* * * * *